US006058753A

United States Patent [19]

Jowitt et al.

[11] Patent Number: 6,058,753

[45] Date of Patent: May 9, 2000

[54] CAN BASE REFORMING

[75] Inventors: Frederick William Jowitt, Bingley; Miles Waterworth, Guiseley, both of United Kingdom; Richard Mark Orlando Golding, Chicago, Ill.

[73] Assignee: Crown Cork & Seal Technologies Corporation, Alsip, Ill.

[21] Appl. No.: 09/207,252

[22] Filed: Dec. 9, 1998

[30] Foreign Application Priority Data

Dec. 10, 1997 [GB] United Kingdom ..... 9726009

[51] Int. Cl.[7] ..... B21D 51/26

[52] U.S. Cl. ..... 72/91; 72/94; 72/117

[58] Field of Search ..... 72/94, 110, 117, 72/123, 126, 91

[56] References Cited

U.S. PATENT DOCUMENTS

| | | | |
|---|---|---|---|
| 3,754,424 | 8/1973 | Costanzo | 72/105 |
| 3,831,416 | 8/1974 | Wolfe | 72/117 |
| 4,885,924 | 12/1989 | Claydon et al. . | |
| 5,372,028 | 12/1994 | Brilman et al. | 72/117 |

FOREIGN PATENT DOCUMENTS

| | | |
|---|---|---|
| 0482581 | 10/1991 | European Pat. Off. . |
| 0559178 | 3/1993 | European Pat. Off. . |
| PCT/GB83/00017 | 1/1983 | WIPO . |

OTHER PUBLICATIONS

British Search Report of Feb. 13, 1998.
EP Search Report of Jun. 22, 1998.

*Primary Examiner*—Lowell A. Larson
*Attorney, Agent, or Firm*—Diller, Ramik & Wight, PC

[57] ABSTRACT

A method and apparatus for reforming the base of a container such as a can having a domed base. The apparatus comprises independent assemblies for rotating the can and for reforming the base profile. The base reforming assembly uses a torque shaft to twist an eccentric and actuate radial movement of a roll into contact with the can base. A stop prevents movement of this roll beyond a predetermined amount, thereby maintaining consistency of profile depth. By minimizing moving parts of the tooling, wear is limited to that which may arise from the stop alone.

11 Claims, 3 Drawing Sheets

CAN BASE REFORMING

BACKGROUND OF THE INVENTION

This invention relates to a method and apparatus for reforming the base of a container. In particular, but not exclusively, it relates to a method and apparatus for reforming the base profile of a can having a one-piece can body used for packaging carbonated beverages.

Such so-called "beverage cans" typically comprise a side wall, a transition region and a base including a stand bead, an annular inner wall and a substantially dome-shaped centre panel. When such beverage cans are manufactured on a bodymaker, the base formed by the dome station usually has a radially inwardly tapering inner wall for ease of removal from the domer. However, in recent years it has become common practice to reshape this inner wall at least to a vertical profile or, more usefully, to a negative angle, or a hooked or beaded profile.

The benefits of reforming the base profile have been demonstrated in terms of limiting dome growth and increasing dome reversal pressure. When the can is pressurised, the dome will "grow" outwards, pushing the metal around the stand diameter so that the stand bead will roll out and the can height will increase. Dome growth is thus a particular problem when the can needs to withstand pasteurisation pressures, such as is the case when the product is beer, for example. Dome reversal pressure is the pressure at which internal pressure from a carbonated beverage, for example, will cause the dome-shaped centre panel to reverse its shape completely from externally concave to externally convex.

Although the principles of base profile reforming are well-known, apparatus which has been available in order to carry out the reforming process has not been found to be entirely satisfactory. External base profile reforming which is carried out by applying radially inward pressure to the transition region of the can is well-established but has problems in terms of defining the final shape which is achieved and/or tool removal where a negative angle is formed by pressing the inner annular wall onto a shaped chuck.

Internal base profile reforming involves the direct application of a roll against the inner wall so as to reform part or all of that wall to a specific new profile. One particular problem which has been found with known internal base profile reforming tooling is that there is a very high rate of wear of tool parts. This wear is particularly costly in terms of replacement parts and, if components are not replaced, will lead to variability in the very profile which is critical to improving can performance.

This invention seeks to provide a solution to these problems, particularly for internal base profile reforming, by eliminating wear as far as possible.

SUMMARY OF THE INVENTION

According to the present invention, there is provided an apparatus for reforming the base profile of a can, the apparatus comprising: a rotatable support for rotating the can; a roller mechanism for forming a desired new profile on the can base; resilient actuating means for moving the roller mechanism radially into contact with the base; and a stop for limiting maximum radial movement and maintaining radial position of the roller mechanism at a desired profile depth.

The term "profile depth" or "depth of reformed feature" is used to mean the radial depth of the feature formed by the roller mechanism. It should not be confused with the height of the feature which is the axial distance from the stand bead, i.e. that part of the base on which the can stands.

In contrast with known apparatus, the apparatus of the present invention thus rotates the can rather than the tooling. Furthermore, by using resilient means for actuating the roller mechanism, wear and/or backlash is taken out of the mechanism which reduces variation in base profile.

In one embodiment, the resilient actuating means includes a cam and cam follower for actuating radial movement of the roller mechanism.

The resilient actuating means may include a torque shaft. This provides resilience between the motion of the actuating means, such as a cam, and the tool. Alternative means such as a spring or rod may be used to allow for overtravel of the cam follower.

An eccentric or a pivot arm may also be used to actuate the roller mechanism. Actuation of the roller mechanism by twisting an eccentric eliminates the need for large pressure angles in linkage such as are found, for example, in pivot and link arm devices when the direction of cam motion is in the direction of the can axis.

The can preferably comprises a one-piece can body having a side wall, a transition region and a base including an annular inner wall and a substantially dome-shaped centre panel. Usually it may be the inner wall which is reformed by the apparatus of this invention.

The roller mechanism may comprise a cross slide in which a roller is mounted for free rotation. In order to rotate the can, the rotatable support may hold any part of the can, internally or externally, side wall or ends, and any part of the ends may be held. Preferably either or both ends of the can are supported for rotating the can.

The stop may comprise a pin mounted in fixed position adjacent the roller mechanism. For example, the stop pin may be mounted such that, when the cross slide is actuated by twisting of an eccentric to move radially, the cross slide will move until it contacts the stop pin. It may then be held in this position during the reforming operation.

The resilient means is preferably resiliently mounted, for example on a spring which is compressible in order to allow the apparatus to be used to reform the bases of cans having different heights or to provide a tolerance to cope with minor variation in can height. This resilient mounting is particularly important when base profile reforming is combined with a spin necking and/or flanging operation.

According to another aspect of the present invention, there is provided a method comprising: rotating the can; resiliently actuating a roller mechanism to move radially into contact with the base; limiting maximum radial movement and maintaining radial position of the roller mechanism; and forming a desired new profile having a constant depth on the can base.

Preferably, the roller mechanism is actuated by twisting an eccentric.

Preferred embodiments of the invention will now be described, by way of example only, with reference to the drawings, in which:

BRIEF DESCRIPTION OF THE DRAWINGS

FIG. 4*b* is an enlarged transverse cross-sectional view through the base profile reforming apparatus of FIG. 4*a.

DESCRIPTION OF THE PREFERRED EMBODIMENTS

Figure 1:
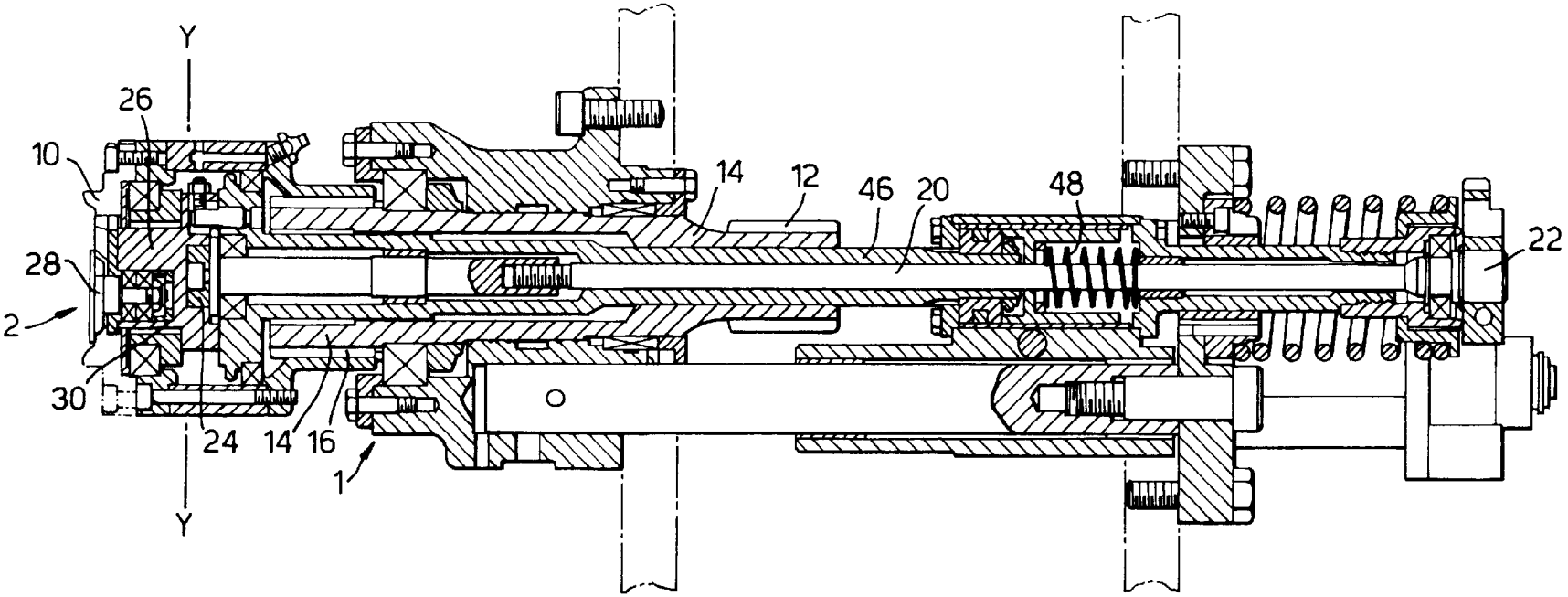
FIG. 1 is a side section of a first embodiment of base profile reforming apparatus.

FIG. 1 shows an apparatus for internal base profile reforming of a beverage can having a domed base. The apparatus comprises two principle sub-assemblies. Outer sub-assembly 1 comprises a pusher 10 which supports the can base and is rotated by means of gear 12 via shaft 14 and splines 16.

Figure 2:
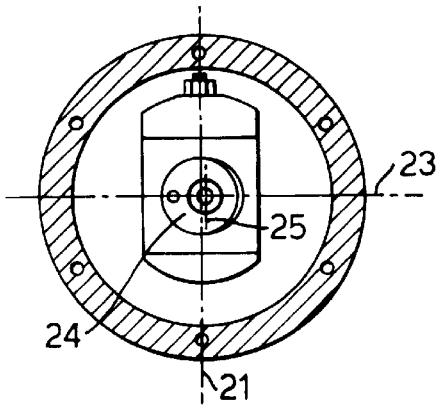
FIG. 2 is a section on Y—Y of FIG. 1.

The remaining apparatus, i.e. central second sub-assembly 2, comprises the reforming tooling. Torque shaft 20 is driven to rotate by segmented gear 22. Torque shaft 20 has an axis having a centre through the point where line 21 crosses line 23 in FIG. 2. A roller 24 is mounted on but eccentric to the torque shaft 20. The eccentricity can be seen from its centre point, which is where lines 25 and 23 cross in FIG. 2. From this figure it can be seen that roller 24 has a central axis which is eccentric to that of the torque shaft 20.

A slide 26 is mounted on eccentric roll 24 and reforming roller 28 is mounted for free rotation via a bearing spacer 30 in slide 26. Movement of slide 26 into space 32 is limited by stop components comprising stop pin 34 and screw 36.

Figure 3:
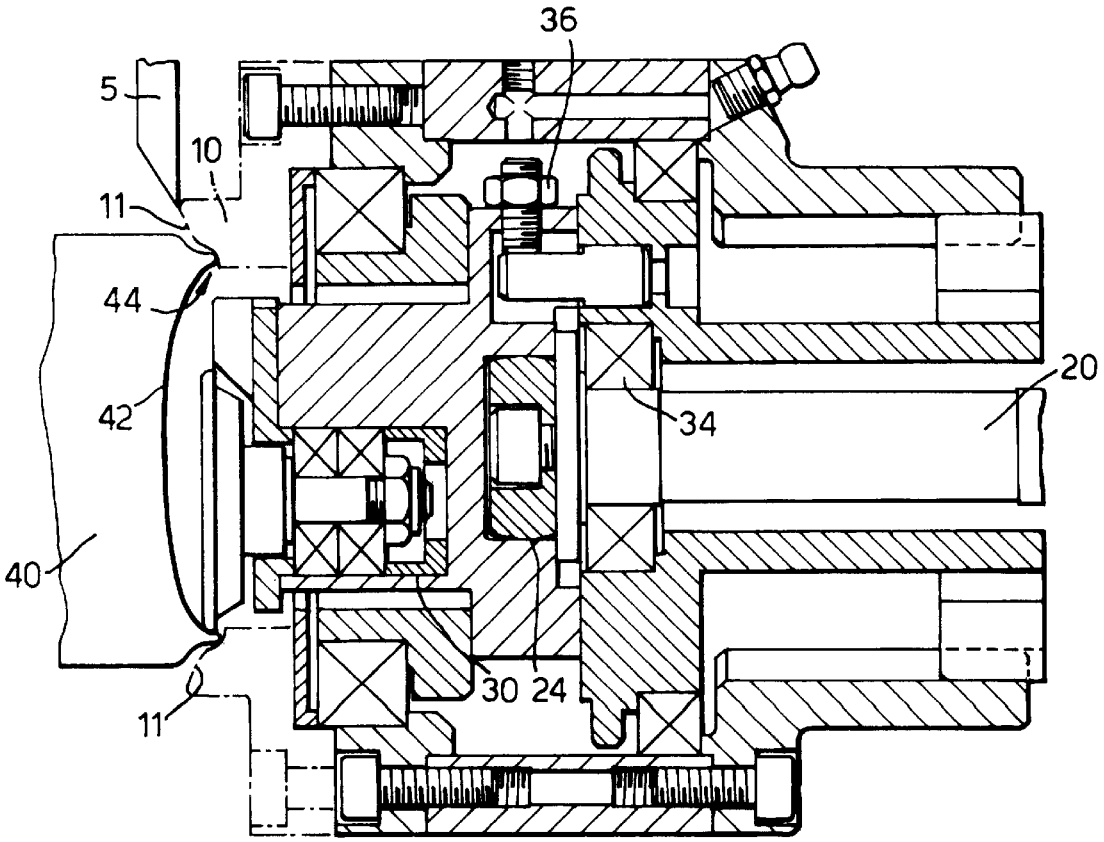
FIG. 3 is the section of FIG. 1, showing a can in position.

FIG. 3 shows a can 40 having a base with a domed central panel 42 and an annular inner wall 44. In operation, the can is placed on the pusher sub-assembly 1 which is axially slidable by virtue of its connection to shaft 14 via spline 16. The pusher can thus be moved axially in order to feed cans onto the reform tooling and to enable the apparatus to be moved axially during a necking operation, if desired. The can is guided onto the pusher by tapered centre profile 11 on the pusher. In this way, the support provided by the pusher is simple contact and will typically hold the can in conjunction with necker tooling at the opposite end of the can.

A stripper guide 5 may also be used to engage the transition region of the can in order to assist in can removal as the pusher assembly is retracted after the reforming process.

The pusher assembly 1 is rotated by means of gear 12 and thereby rotates can 40. Can rotation is independent of the base profile reforming sub-assembly 2 by virtue of shaft 46 which does not rotate.

Gear 22 (see FIG. 1) rotates the torque shaft 20 which twists eccentric 24. The eccentric 24 then actuates radial movement of cross slide 26 until the slide 26 contacts stop pin 34. In that position the torsion shaft is fully torqued up. The position of stop pin 34 is set so that the roll 28 mounted in slide 26 will reform the inner wall 44 of the base 42 of a can which is in position on pusher 10 to the desired profile depth. This depth will depend on the specification of can material and the desired form of base profile.

Typically initial contact with the inner wall will take place after one revolution of the can. Once in contact with the inner wall of the can base, the roll 28 will carry out the reforming process as the can is rotated. This may take about three can revolutions to form the desired profile with typically a further two revolutions in order to obtain a consistent depth of the reformed feature. This ability to obtain a consistent depth is unique to the machine of the present invention which combines can rotation with resilient actuating means, such as the torque shaft of this embodiment, and a stop mechanism to control the profile around the can base, as well as between different cans.

The height at which the base profile feature is obtained is determined by the dimensions of spacer 30 on which roll 28 is mounted. This spacer 30 may be replaced or reground where changes in profile height are required. Different can heights can be accommodated by compression of spring and spacer change parts 48 shown in FIG. 1. This is particularly useful when base profile reforming is combined in a single apparatus with a necking and flanging operation.

Figure 4A:
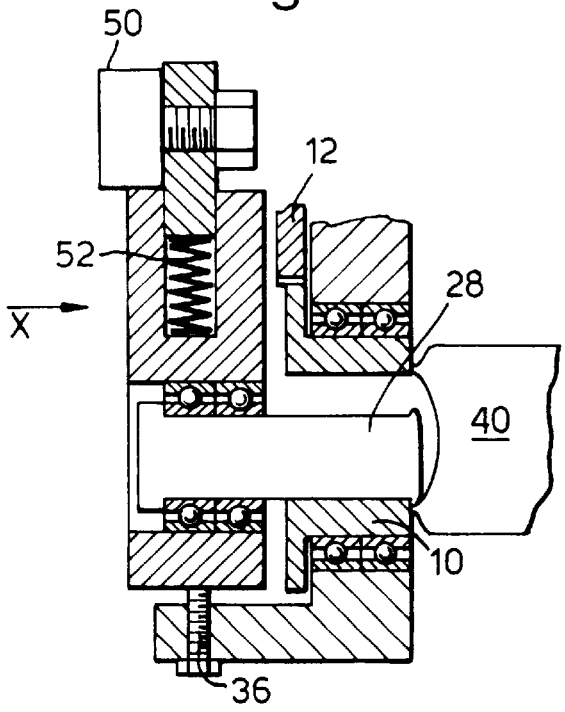
FIG. 4*a* is an enlarged, fragmentary longitudinal cross-sectional view through a second embodiment of the base profile reforming apparatus.
Figure 4B:
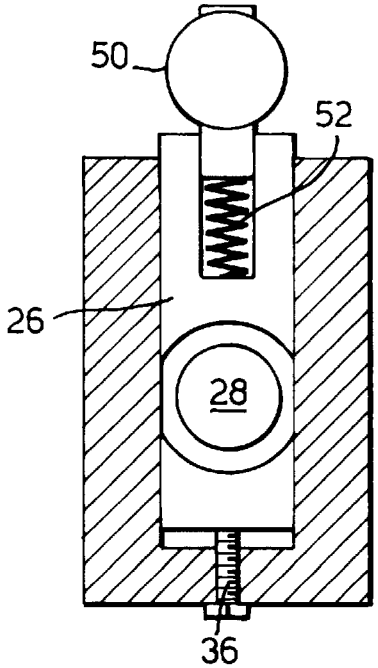

An alternative arrangement of base profile reforming apparatus is shown in FIGS. 4*a* and 4*b*. The schematic side section of FIG. 4*a* shows the pusher support 10 which is rotated by means of gear 12 in order to rotate the can 40. Independently of the can rotation is a similar cross-slide 26 arrangement to that of FIGS. 1 to 3 but in which the cross-slide is actuated linearly by a cam and cam follower 50. The cam follower is mounted on a spring 52, at the opposite end of cross slide 26 to end stop 36. This spring "replaces" the function of the torque shaft of the first embodiment in that it provides resilience to the cam follower to allow for overtravel and prevents excessive motion of the cam.

Figure 5:
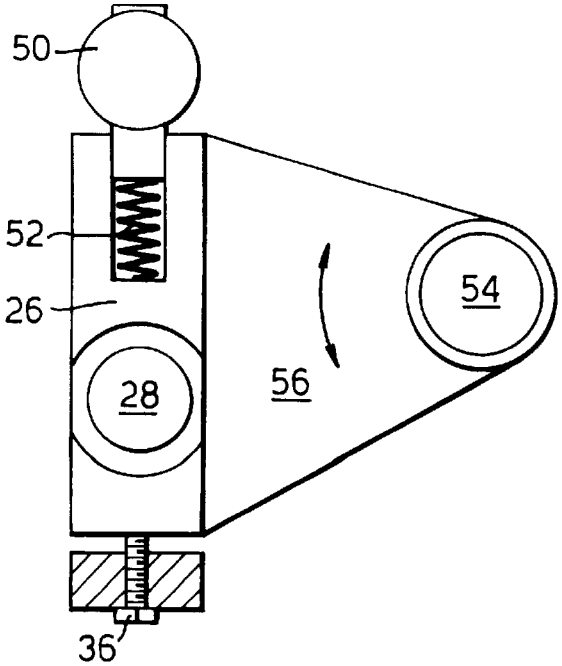
* and FIG. 5 is a schematic of a third embodiment of the invention.

In a further embodiment of the invention, the cross slide 26 is actuated by a pivot arm arrangement 54, 56, as shown in FIG. 5. In this embodiment, the cross slide is operated on through an arc, rather than linearly as in the embodiment of FIG. 4. In this arrangement, the cam acts perpendicularly to the can axis, thus avoiding the large pressure angles found in prior art pivot arm designs.

Any of the embodiments of can base reforming apparatus and methods of the present invention can be used to change the profile of the base of a beverage can which has been made in the doming station of a can bodymaker. The doming process may be made easier by producing more complex profiles in this separate reforming stage. The use of this base reforming station may also allow thinner gauge material to be used and enable the inside can profile to be easier to spray with lacquer, for example.

This method and apparatus dramatically reduce component wear and subsequent maintenance expenditure and substantially eliminate any depth variation in reformed base profile both on individual cans and between cans.

Although a preferred embodiment of the invention has been specifically illustrated and described herein, it is to be understood that minor variations may be made in the apparatus without departing from the spirit and scope of the invention, as defined the appended claims.

We claim:

1. An apparatus for reforming the base profile of a can, the apparatus comprising:

a rotatable support for rotating the can;

a roller mechanism for forming a desired new profile on the can base;

resilient actuating means for moving the roller mechanism radially into contact with the base; and a stop for limiting maximum radial movement and maintaining radial position of the roller mechanism at a desired profile depth.

2. An apparatus according to claim 1, in which the resilient actuating means comprises a torque shaft, spring or rod of resilient material.

3. An apparatus according to claim 2, in which the resilient actuating means includes a cam and cam follower for actuating radial movement of the roller mechanism.

4. An apparatus according to claim 2, in which the roller mechanism comprises a cross slide and roller, the roller being mounted in the cross slide for free rotation.

5. An apparatus according to claim 1, in which the resilient actuating means includes a cam and cam follower for actuating radial movement of the roller mechanism.

6. An apparatus according to claim 1, in which the roller mechanism comprises a cross slide and roller, the roller being mounted in the cross-slide for free rotation.

7. An apparatus according to claim 1, in which the resilient actuating means further comprises an eccentric or a pivot arm.

8. An apparatus according to claim 1, in which the rotatable support supports any part of the can.

9. An apparatus according to claim 1, in which the stop comprises a pin mounted in fixed position adjacent the roller mechanism.

10. A method of reforming the base profile of a can, the method comprising:

rotating the can;

resiliently actuating a roller mechanism to move radially into contact with the base;

limiting maximum radial movement and maintaining radial position of the roller mechanism; and forming a desired new profile having a constant depth on the can base.

11. A method according to claim 10, in which the roller mechanism is actuated by twisting an eccentric.

* * * * *